US007518602B2

(12) United States Patent
Nozawa

(10) Patent No.: US 7,518,602 B2
(45) Date of Patent: Apr. 14, 2009

(54) TEST CIRCUIT AND DISPLAY DEVICE HAVING THE SAME

(75) Inventor: Ryo Nozawa, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 673 days.

(21) Appl. No.: 11/290,792

(22) Filed: Nov. 30, 2005

(65) Prior Publication Data

US 2006/0156111 A1 Jul. 13, 2006

(30) Foreign Application Priority Data

Dec. 6, 2004 (JP) ..... 2004-353292

(51) Int. Cl.
*G09G 5/00* (2006.01)

(52) U.S. Cl. ..... 345/204; 345/205; 345/206; 345/690

(58) Field of Classification Search ..... 345/204–206, 345/690
See application file for complete search history.

(56) References Cited

U.S. PATENT DOCUMENTS

| | | | | |
|---|---|---|---|---|
| 4,775,891 | A | 10/1988 | Aoki et al. | 358/160 |
| 5,068,547 | A | 11/1991 | Gascoyne | 307/443 |
| 5,367,551 | A * | 11/1994 | Okumura et al. | 377/80 |
| 5,410,247 | A | 4/1995 | Ishizuka | 324/158.1 |
| 5,825,204 | A | 10/1998 | Hashimoto | 326/54 |
| 6,573,774 | B1 | 6/2003 | Gardner | 327/201 |
| 6,711,041 | B2 | 3/2004 | Pereira et al. | 365/49 |
| 6,762,617 | B2 | 7/2004 | Iwase et al. | 326/11 |
| 6,762,735 | B2 | 7/2004 | Koyama | 345/76 |
| 6,850,080 | B2 | 2/2005 | Hiroki | 324/750 |
| 2001/0035526 | A1 | 11/2001 | Yamazaki et al. | 257/57 |
| 2001/0040565 | A1 | 11/2001 | Koyama | 345/204 |
| 2002/0130675 | A1 | 9/2002 | Hiroki | 324/750 |
| 2002/0132383 | A1 | 9/2002 | Hiroki et al. | 438/17 |
| 2004/0119824 | A1 | 6/2004 | Osada | 348/180 |
| 2004/0239598 | A1 | 12/2004 | Koyama | 345/76 |
| 2005/0035805 | A1 | 2/2005 | Tanada | 327/291 |
| 2005/0212044 | A1 | 9/2005 | Hiroki | 257/347 |

FOREIGN PATENT DOCUMENTS

| | | | |
|---|---|---|---|
| JP | 05-256914 | | 10/1993 |
| JP | 2618042 | | 6/1997 |
| JP | 2001-215463 A | * | 8/2001 |
| JP | 2002-014337 | | 1/2002 |
| JP | 2002-032035 | | 1/2002 |
| JP | 2002-116423 | | 4/2002 |
| JP | 2002-350513 | | 12/2002 |
| JP | 2003-013814 | | 1/2003 |
| WO | WO 2004/086070 A1 | | 7/2004 |

* cited by examiner

*Primary Examiner*—Richard Hjerpe
*Assistant Examiner*—Leonid Shapiro
(74) *Attorney, Agent, or Firm*—Cook Alex Ltd.

(57) ABSTRACT

A test circuit and a test method capable of easily and accurately determining the presence or absence of a defect as well as defective points. The test circuit of the invention has a plurality of shift registers, a plurality of latch circuits, a plurality of first NOR circuits, a plurality of second NOR circuits, a plurality of first NAND circuits, a plurality of second NAND circuits, and a plurality of inverters. A plurality of source signal lines provided in a pixel area are connected to the respective plurality of latch circuits, and a test output is outputted from the inverter of the last stage.

15 Claims, 14 Drawing Sheets

TEST CIRCUIT AND DISPLAY DEVICE HAVING THE SAME

BACKGROUND OF THE INVENTION

1. Field of the Invention

The present invention relates to a test circuit provided in a display device having a pixel area where pixels are arranged in matrix, and to a test method of the display device.

2. Description of the Related Art

In recent years, display devices such as liquid crystal displays (LCDs) and electroluminescence (EL) displays have been increased in screen size and resolution, and highly integrated circuits have been developed by integrating a pixel portion and periphery circuits for controlling the pixel portion over the same substrate.

If an element is damaged in manufacturing steps due to shape defects, electrostatic discharge damage (ESD) or the like, a display device itself cannot operate normally and thus should be removed by quality control. In general, the quality control of a display device is performed for such a module 1200 as shown in FIG. 14A, which is completed by attaching an opposite substrate 1202 to a TFT substrate 1201 over which a source driver 1203, a gate driver 1204, a pixel area 1205, a signal input terminal 1206 and the like are formed. Then, as shown in FIG. 14B, a signal is inputted to the module 1200 using a jig or the like, and images (test pattern 1212 and the like) are actually displayed to determine the presence or absence of a defect by viewing a screen.

However, such a method is disadvantageous in that the display device is tested when it is almost completed as the module 1200, and thus the module determined to be defective costs much. In other words, since defects due to circuit malfunction are caused only by the TFT substrate 1201, steps of attaching the opposite substrate 1202 and the like are not necessary. There is also a case where only a substrate (TFT substrate) over which a pixel portion and a periphery circuit are formed using TFTs and the like is produced and shipped as a semi-finished product. In this case, however, quality control cannot be performed by actually displaying images, and a means for determining whether a circuit over a TFT substrate operates normally is required.

FIG. 13 shows an example of a configuration to achieve such quality control. A digital source driver 18 having a shift register (SR), a NAND circuit, a latch, a D/A converter (DAC) and the like, a gate driver 5, a pixel area where pixels 3 are arranged in matrix, and a test circuit having a driver circuit 30, an analog switch 25, a test line 27, a test terminal 28 and the like are formed over a substrate.

In the display device shown in FIG. 13, each gate signal line 6 controls pixels connected to the line, and a video signal is inputted to the digital source driver 18, outputted to a source signal line 9, and written to each pixel.

In the test circuit, the analog switch 25 is controlled by the driver circuit 30, and charges held when a video signal is written to a pixel are outputted to the test terminal 28 through the test line 27, thereby determining whether writing to the pixel is good or bad (see Patent Document 1). There is another test method where a test pad is provided for each source signal line 9 and output is tested by applying a probe to each pad (see Patent Document 2).

As a test method performed before a TFT substrate is attached to an opposite substrate, there is a method where a test capacitor is provided to be connected to a drain region of a driving TFT in a pixel portion, and the charging and discharging of the test capacitor are checked to determine whether the driving TFT operates normally (see Patent Document 3). As another method, electromagnetic induction from a coil is used to drive a circuit over an element substrate, and an electromagnetic wave or an electric filed generated in the circuit is monitored (see Patent Documents 4 and 5).

[Patent Document 1] Japanese Patent Laid-Open No. 2002-116423

[Patent Document 2] Japanese Patent No. 2618042

[Patent Document 3] Japanese Patent Laid-Open No. 2002-032035

[Patent Document 4] Japanese Patent Laid-Open No. 2002-350513

[Patent Document 5] Japanese Patent Laid-Open No. 2003-031814

SUMMARY OF THE INVENTION

The methods disclosed in the aforementioned patent documents, however, have problems in that test throughput decreases considerably in a display device with high resolution and a large screen, and control by the driver circuit 30 or the like is indispensable, leading to increased area occupied by a test circuit over a substrate. In particular, such a method as disclosed in Patent Document 1 is not practical for a display device with high resolution.

In view of the aforementioned problems, the invention provides a test circuit and a test method capable of highly accurately determining circuit operation, line defects, and defective points.

The invention takes the following measures to solve the aforementioned problems.

It is not practical to use a probe to test each signal outputted to a signal line since the number of signal lines increases with higher resolution. According to the invention, output of signal lines of all stages is inputted to a test circuit and only an output corresponding to a specific pattern is measured among the inputted signals.

If an output of one signal line is incorrect, an output different from the aforementioned one is obtained. Accordingly, the presence or absence of a defect as well as a defective point can be determined by measuring one or more outputs and comparing them to the output that is normally obtained.

According to the invention, a test circuit of a display device having a plurality of pixels arranged in matrix, and a plurality of source signal lines for inputting a video signal to each of the plurality of pixels, includes a plurality of shift registers, a plurality of latch circuits, a plurality of first NOR circuits, a plurality of second NOR circuits, a plurality of NAND circuits, a plurality of second NAND circuits, and a plurality of inverters, wherein the plurality of shift registers are connected in series to each other, the plurality of shift registers are electrically connected to the respective plurality of latch circuits, first input terminals of the plurality of first NOR circuits are electrically connected to the respective plurality of shift registers, second input terminals of the plurality of first NOR circuits are electrically connected to the respective plurality of latch circuits, the plurality of source signal lines are electrically connected to the respective plurality of latch circuits, the plurality of second NOR circuits are connected in parallel to each other, the plurality of second NOR circuits are electrically connected to the respective plurality of first NOR circuits, the plurality of first NAND circuits are connected in parallel to each other, the plurality of first NAND circuits are electrically connected to the respective plurality of second NOR circuits, the plurality of first NAND circuits are electrically connected to the respective plurality of second NAND circuits, among the plurality of second NAND circuits connected in series, a second input terminal of the NAND circuit of a first stage is electrically connected to a power supply, input terminals of the plurality of inverters are electrically connected to output terminals of the plurality of second NAND circuits, output terminals of the plurality of inverters are electrically connected to input terminals of the plurality of second NAND circuits that are different from the plurality of second NAND circuits connected to the input terminals of the plurality of inverters, and an output terminal of the inverter of a last stage is electrically connected to a test output terminal. The invention also includes a substrate having the test circuit as well as a display device having the test circuit.

According to the invention, a test method of a display device has a step of inputting a test signal to the display device to output a test output to a test output terminal using the aforementioned test circuit of the display device.

By checking the test output obtained by the test method of the invention, a defective point can be determined.

FIG. 11A shows the aforementioned test circuit. A test circuit 1102 is formed over a substrate at the same time as pixel TFTs, and mounted on the outside of a panel. A test pad is provided for each source signal line, and a probe 1101 is applied to each pad. Each source signal line extends perpendicularly to the outside of the panel through the pixel portion so as to be electrically connected to the test circuit. An opposite substrate is not attached to the panel at this time, and attached by vapor deposition or the like after the test is completed. The test circuit can be detached after the test, and does not affect the panel size.

Even when a driver circuit is not provided as shown in FIG. 11B, test can be performed if each source signal line is electrically connected to a test circuit 1113 through a pixel portion. A probe 1112 that is different from a probe 1111 for inputting may be used for an output terminal of the test circuit. In addition, even when a driver circuit is provided between a test circuit and a pixel portion in a configuration where the pixel portion is sandwiched between two driver circuits, test can be performed as long as a source signal line is connected to the test circuit.

In the test method of a display device according to the invention, used as the test video signal is a video signal to allow outputs of the source signal lines provided in the pixel portion to be at H level or L level in all stages.

According to the invention, a display device can be tested when a TFT substrate is completed, without viewing and checking an actual test pattern display. Further, a defective point can be determined highly accurately, which allows effective quality control. For example, in the case of a short circuit between wires or the like due to foreign materials, a defective point can be determined immediately and the foreign materials can be removed since a TFT substrate is exposed.

Specifically, whether a circuit operates normally can be determined in various kinds of display devices such as LCDs, EL displays, and plasma displays, each of which uses a driver that receives a digital video signal and outputs a digital video signal to a source signal line. In addition, the presence or absence of a defect as well as a defective point can be immediately determined in all stages only by checking H level or L level of outputs of test output terminals regardless of the number of source signal lines. Thus, the test method of the invention is effective for a display device used for a panel with a large screen and high resolution.

According to the aforementioned test method, in a display device adopting a line sequential digital drive system, all the outputs of source signal lines or all the outputs of test circuits connected to the source signal lines are not required to be checked, and the presence or absence of a defect as well as a defective point can be determined in all stages only by checking an output of a test output terminal connected to the test circuit of the last stage. Even when the number of source signal lines increases with increase in resolution and screen size, test can be performed with extremely high throughput.

DETAILED DESCRIPTION OF THE INVENTION

Embodiment Mode 1

Figure 1A:
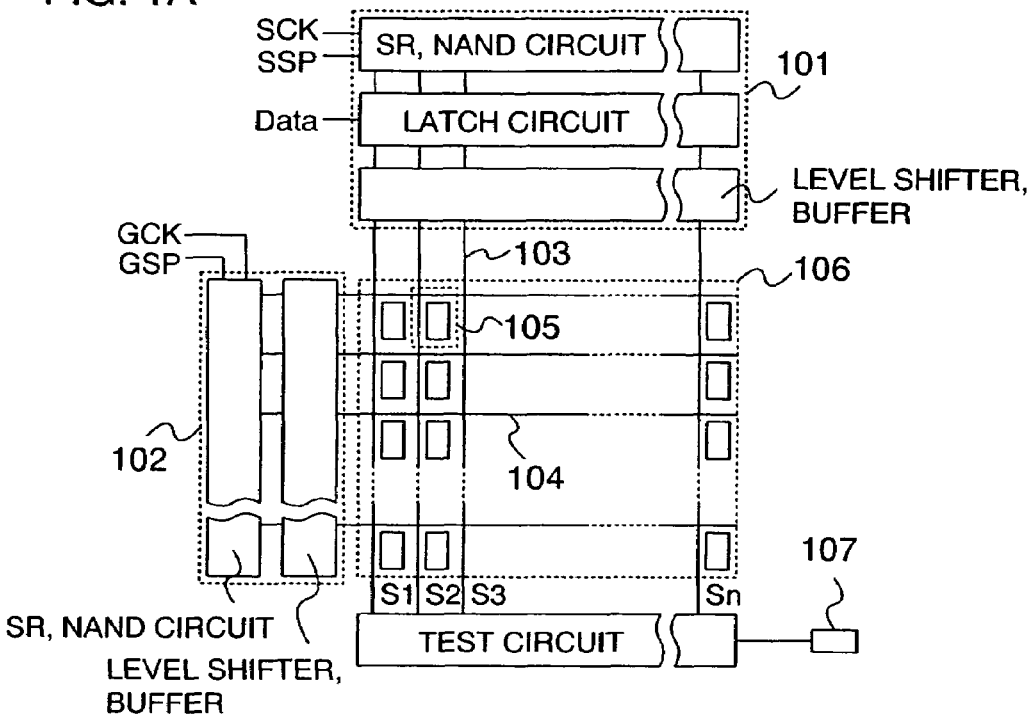
FIGS. 1A and 1B are diagrams showing one embodiment mode of the invention.

FIG. 1A shows one embodiment mode of the invention. A source driver 101, a gate driver 102, a pixel area 106, a test circuit, and a test output terminal 107 are formed over a substrate. The pixel area 106 includes a plurality of pixels 105 arranged in matrix, each of which is controlled by a source signal line 103 and a gate signal line 104.

In the source driver 101, sampling pulses are sequentially outputted from an SR and a NAND circuit when a clock signal (SCK) and a start pulse (SSP) are inputted thereto. Then, amplitude conversion or amplification is carried out in a level shifter and a buffer, and video signals (Data) are sampled to be sequentially outputted to source signal lines (S1 to Sn).

In the gate driver 102, row selection pulses are sequentially outputted from an SR and a NAND circuit when a clock signal (GCK) and a start pulse (GSP) are inputted thereto. Then, amplitude conversion or amplification is carried out in a level shifter and a buffer to sequentially select gate signal lines (G1 to Gm).

Figure 1B:
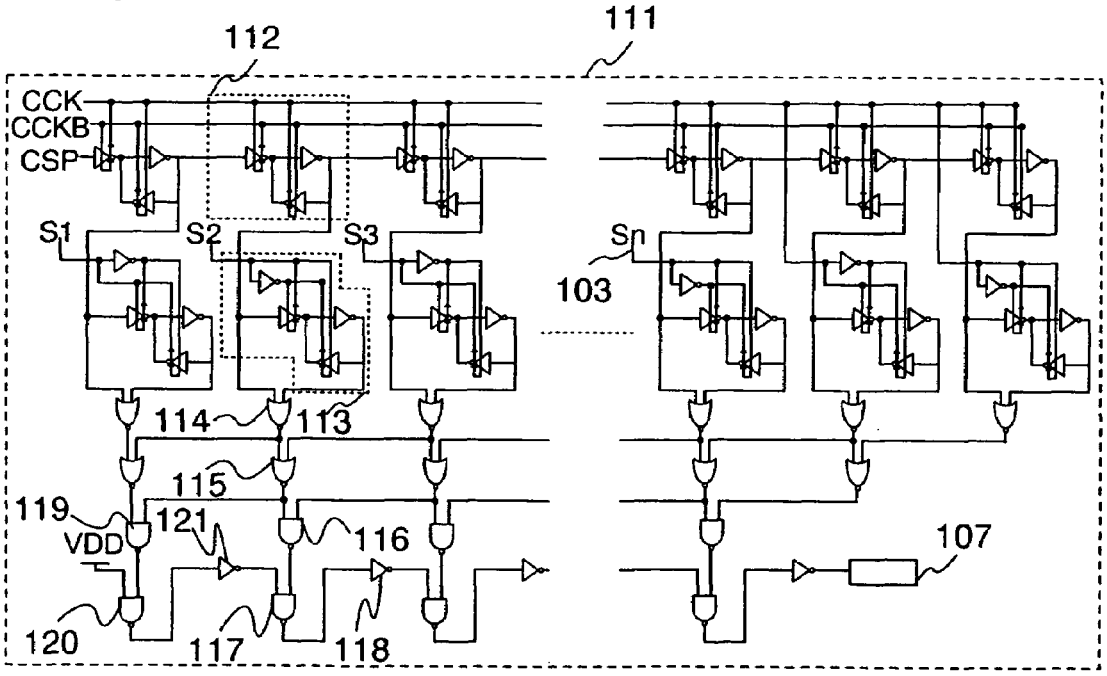

FIG. 1B shows a configuration of a test circuit 111. In the test circuit 111, a plurality of shift registers 112 are connected to a respective plurality of latch circuits 113, the source signal lines 103 are connected to the respective latch circuits 113, the plurality of shift registers 112 and the plurality of latch circuits 113 are connected to a respective plurality of first NOR circuits 114, the plurality of first NOR circuits 114 and a plurality of first NOR circuits of the next stage are connected to a respective plurality of second NOR circuits 115, the plurality of second NOR circuits 115 and a plurality of second NOR circuits of the next stage are connected to a respective plurality of first NAND circuits 116, the plurality of first NAND circuits 116 and a plurality of first NAND circuits of the next stage are connected to a respective plurality of second NAND circuits 117, the plurality of second NAND circuits 117 are connected in series through a plurality of inverters 118, and a signal from the last stage is outputted to the test output terminal 107.

Each of the shift registers 112 in the test circuit sequentially outputs pulses when a clock signal (CCK), an inverted clock signal (CCKB), and a start pulse (CSP) are inputted thereto.

The latch circuits 113 in the test circuit are connected to the respective shift registers 112. Each of the source signal lines 103 is directly connected to one clocked inverter and is connected to the other clocked inverter through an inverter, and the position of the inverter is reversed in an odd-numbered stage and an even-numbered stage.

Specifically, the latch circuit 113 of the m-th stage (1<m<n, m and n are natural numbers) is connected to a scan pulse that is an output of the shift register 112 of the m-th stage and to the source signal line (Sm). A first input terminal of the first NOR circuit 114 of the m-th stage is connected to an output terminal of the latch circuit 113 of the m-th stage, while a second input terminal thereof is connected to an output terminal of the shift register 112 of the m-th stage that is connected to the latch circuit connected to the first input terminal. A first input terminal of the second NOR circuit 115 of the m-th stage is connected to an output terminal of the first NOR circuit 114 of the m-th stage, while a second input terminal thereof is connected to an output terminal of the first NOR circuit of the next stage, namely, the (m+1)th stage. A first input terminal of the first NAND circuit 116 of the m-th stage is connected to an output terminal of the second NOR circuit 115 of the m-th stage, while a second input terminal thereof is connected to an output terminal of the second NOR circuit of the (m+1)th stage. A first input terminal of a second NAND circuit 120 of the first stage is connected to a power supply (VDD) while a second input terminal thereof is connected to an output terminal of a first NAND circuit 119 of the first stage, and an output terminal of the second NAND circuit 120 of the first stage is connected to an input terminal of an inverter 121 of the first stage. In the second stage or later, for example in the k-th stage (2=k=n, k is a natural number), a first input terminal of the second NAND circuit of the k-th stage is connected to an output terminal of an inverter 118 of the (k−1)th stage, a second input terminal thereof is connected to an output terminal of the first NAND circuit of the k-th stage, and an output terminal thereof is connected to an input terminal of the inverter of the k-th stage. An output terminal of the inverter of the k-th stage is connected to a first input terminal of the second NAND circuit of the (k+1)th stage. A signal from the inverter of the last stage is outputted to the test output terminal 107.

Next, actual test steps are described using as an example a source driver that adopts a line sequential digital drive system.

In order to perform the test, the source driver 101 is operated. The source driver 101 may operate in the same manner as in normal image display; however, a video signal is inputted to allow outputs of all the source signal lines to be at H level or L level.

Figure 2:
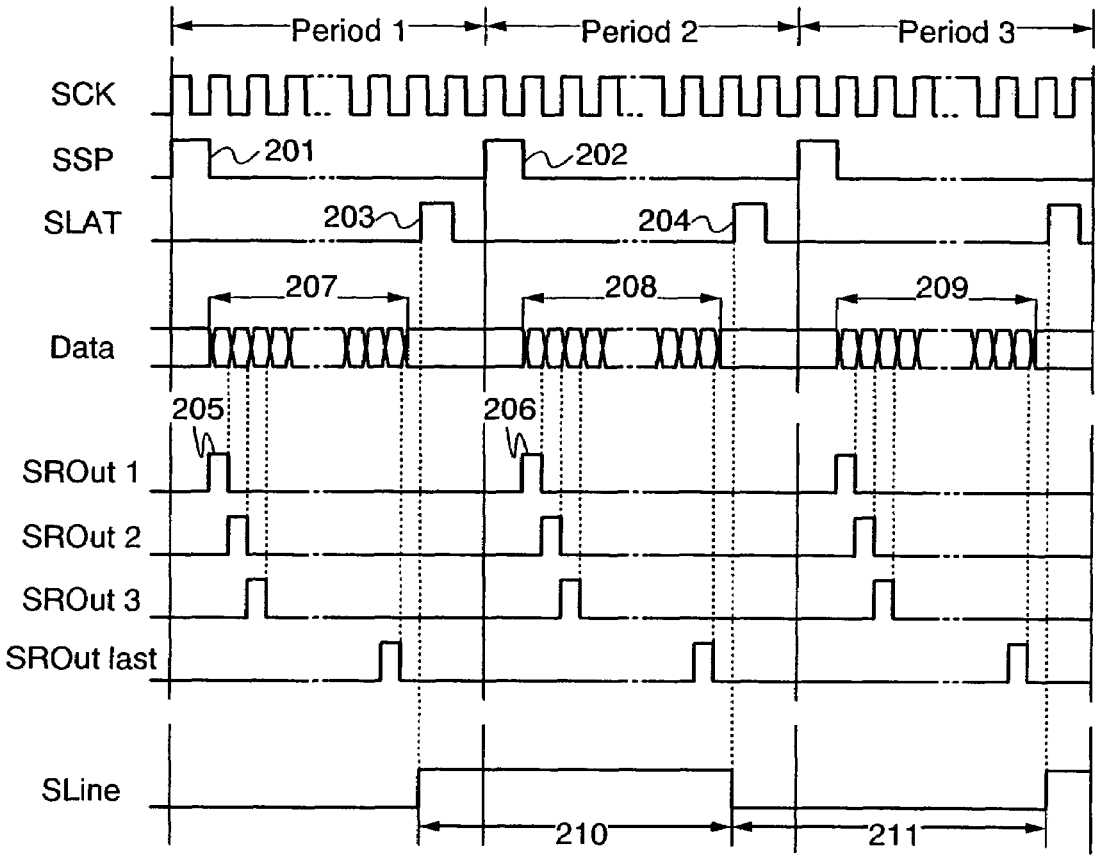
FIG. 2 is a timing chart of a source driver.

FIG. 2 is a simple timing chart of the source driver 101, and operation thereof is described below. In FIG. 2, a clock signal (SCK), a start pulse (SSP), a latch pulse (SLAT), and a digital video signal (Data) are shown as input signals, and sampling pulses of the first to third stages and the last stage (SROut1 to SROut3, and SROut last), and a source signal line output (SLine) are shown as output signals.

First, a first line period (Period 1) is described. The shift register operates in accordance with a clock signal and a start pulse 201, and sequentially outputs a sampling pulse 205. The sampling pulse 205 samples a digital video signal to hold data in the latch circuit.

Note that in the first line period, digital video signals 207 are all at H level.

When the sampling of the digital video signal of the last stage is completed, and then a latch pulse 203 is inputted, the data held in the latch circuit is simultaneously outputted to the source signal lines. Outputs of the source signal lines at this time are also held in the latch circuit until the next latch pulse 204 is inputted.

At this time, outputs of the source signal lines are at H level in all the stages (210).

Then, a second line period (Period 2) starts. Similarly to the first line period, a sampling pulse 206 is sequentially outputted in accordance with a clock signal and a start pulse 202, and a digital video signal is sampled.

Note that in the second line period, digital video signals 208 are all at L level.

When a latch pulse 204 is inputted, the data held in the latch circuit is simultaneously outputted to the source signal lines. At this time, outputs of the source signal lines are at L level in all the stages (211).

Figure 3:
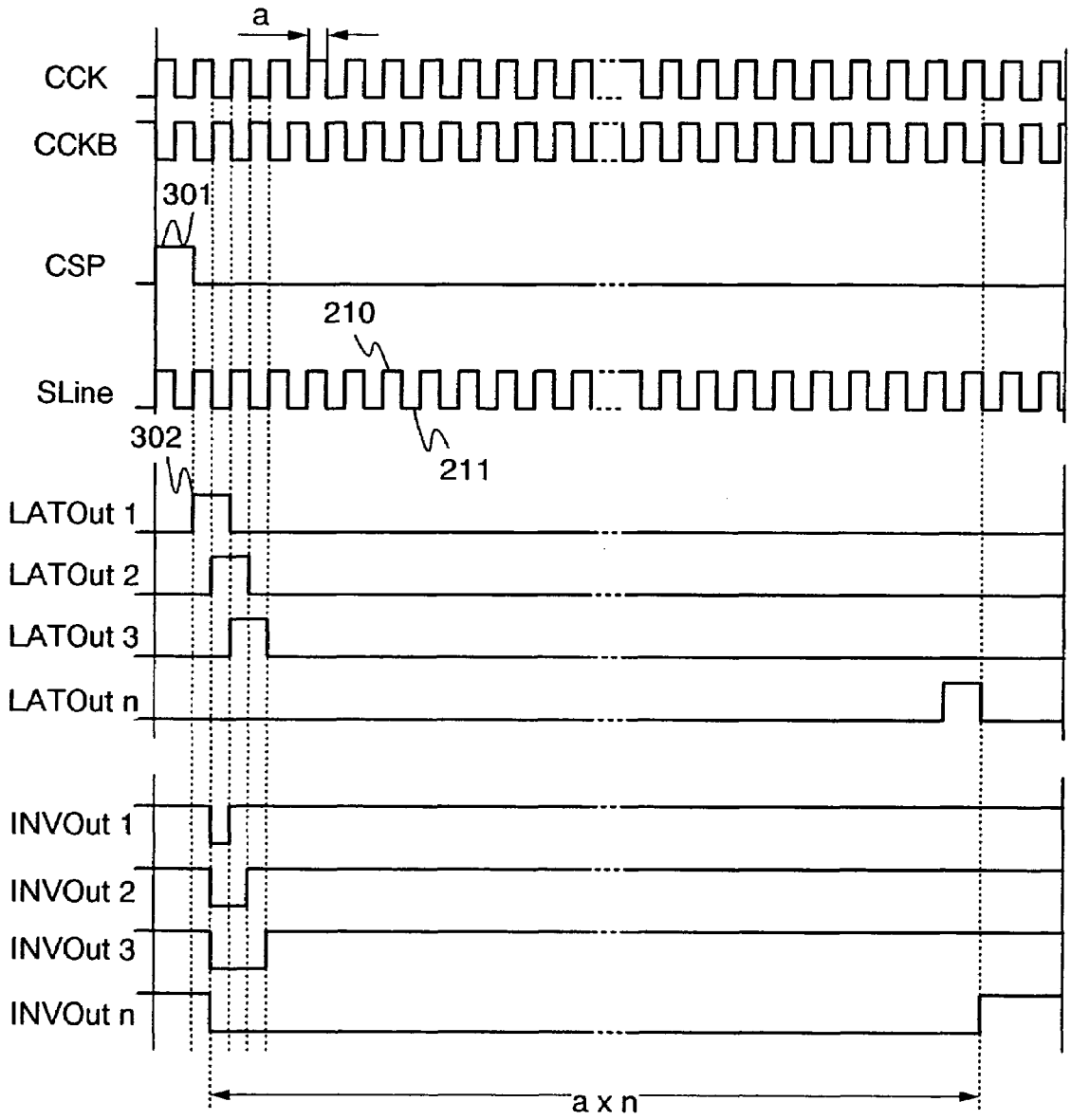
FIG. 3 is a timing chart in normal operation.

Operation and the like of the test circuit are described. During the period 210, H level signals are outputted to the source signal lines in all the stages. Meanwhile, during the period 211, L level signals are outputted to the source signal lines in all the stages. As shown in FIG. 3, digital video signals are controlled so that each level of the source signal line (SLine) has the same period of time. Specifically, a clock signal (CCK) that is at the same level as the source signal line, and an inverted clock signal (CCKB) that is an inverted signal of the clock signal are inputted to the shift register 112 in the test circuit. Further, a start pulse signal (CSP) 301 having the same pulse width as one period of a clock signal is inputted to the shift register.

Output pulses (LATOut1 to LATOut3, and LATOutn) of the latch circuit 113 connected to the shift register are delayed by a half period of a clock signal as shown in FIG. 3, and the latch circuit 113 operates in the same manner as the shift register. An output 302 from the first stage is delayed from CSP by one period of a clock signal, and outputs of the second stage or later are delayed by a half period (a) one by one.

Each of output pulses (INVOut1 to INVOut3, and INVOutn) of the inverter 118 connected to the output terminal of the second NAND circuit 117 in the test circuit becomes longer by a half period (a) of a clock signal each time the stage of the L level period increases. Accordingly, the L level period of an output pulse (INVOutn) from the n-th stage, which is outputted to the test output terminal 107, is equal to a×n.

The state of the test output terminal at this time is a normal test output, where the output of the source signal lines is alternately at H level and L level in all the stages and the length of each period is the same.

The following kinds of malfunction modes A to F are assumed herein.

A: The output of the source signal line (S4) is fixed to H level.

B: The output of the source signal line (S4) is fixed to L level.

C: The output of the source signal line (S4) is inverted to the normal level.

D: The output of the source signal lines (S3 and S5) is fixed to H level.

E: The output of the source signal line (S2) is fixed to H level while the output of the source signal line (Sn, n is an even number) is fixed to L level.

F: The output of the source signal line (S2) is fixed to L level while the output of the source signal line (Sn, n is an even number) is inverted to the normal level.

G: The output of the source signal line (S2) is fixed to L level while the output of the source signal line (S3) is fixed to H level.

These malfunction modes can be caused, for example, by a short circuit between the source signal line and the power supply line or the like due to an etching defect, or by a circuit malfunction due to element damage caused by electrostatic discharge damage during manufacturing steps. Operation of the test circuit in each of the malfunction modes A to G is described below.

Figure 4:
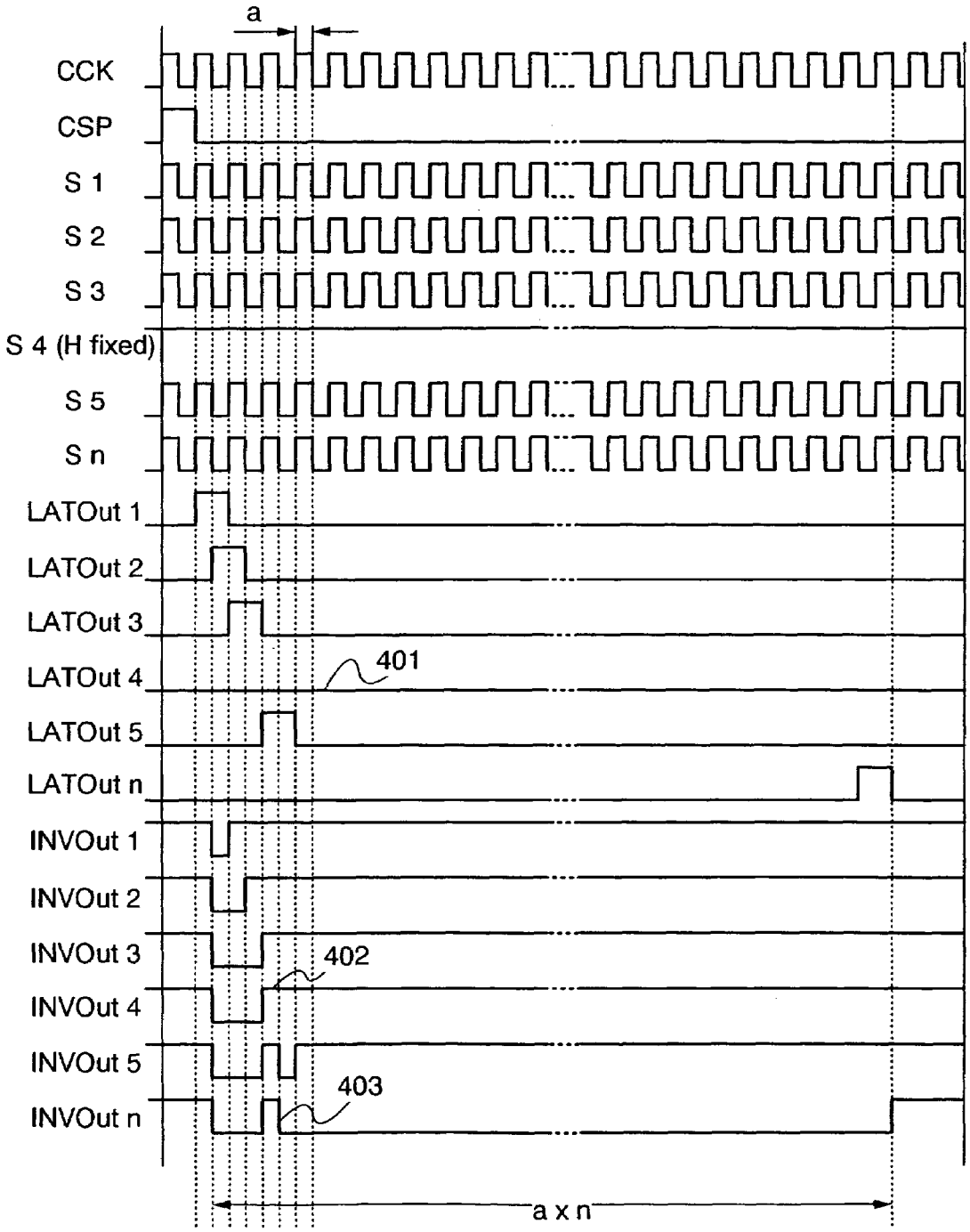
FIG. 4 is a timing chart in malfunction mode A.

FIG. 4 is a timing chart in the malfunction mode A where the source signal line (S4) is fixed to H level regardless of the digital video signal. In this case, an output (LATOut4) 401 fixed to L level is outputted from the latch circuit 113 of the fourth stage. Referring to an output (INVOut4) of the inverter 118 of the fourth stage, the fourth output 402 in the L level period becomes H level if dividing by a half period of a clock signal. Among outputs of the test output terminals (INVOutn) 107, only the fourth output 403 becomes H level during the L level period (a×n); therefore, the fourth source signal line (S4) is determined to be defective.

Figure 5:
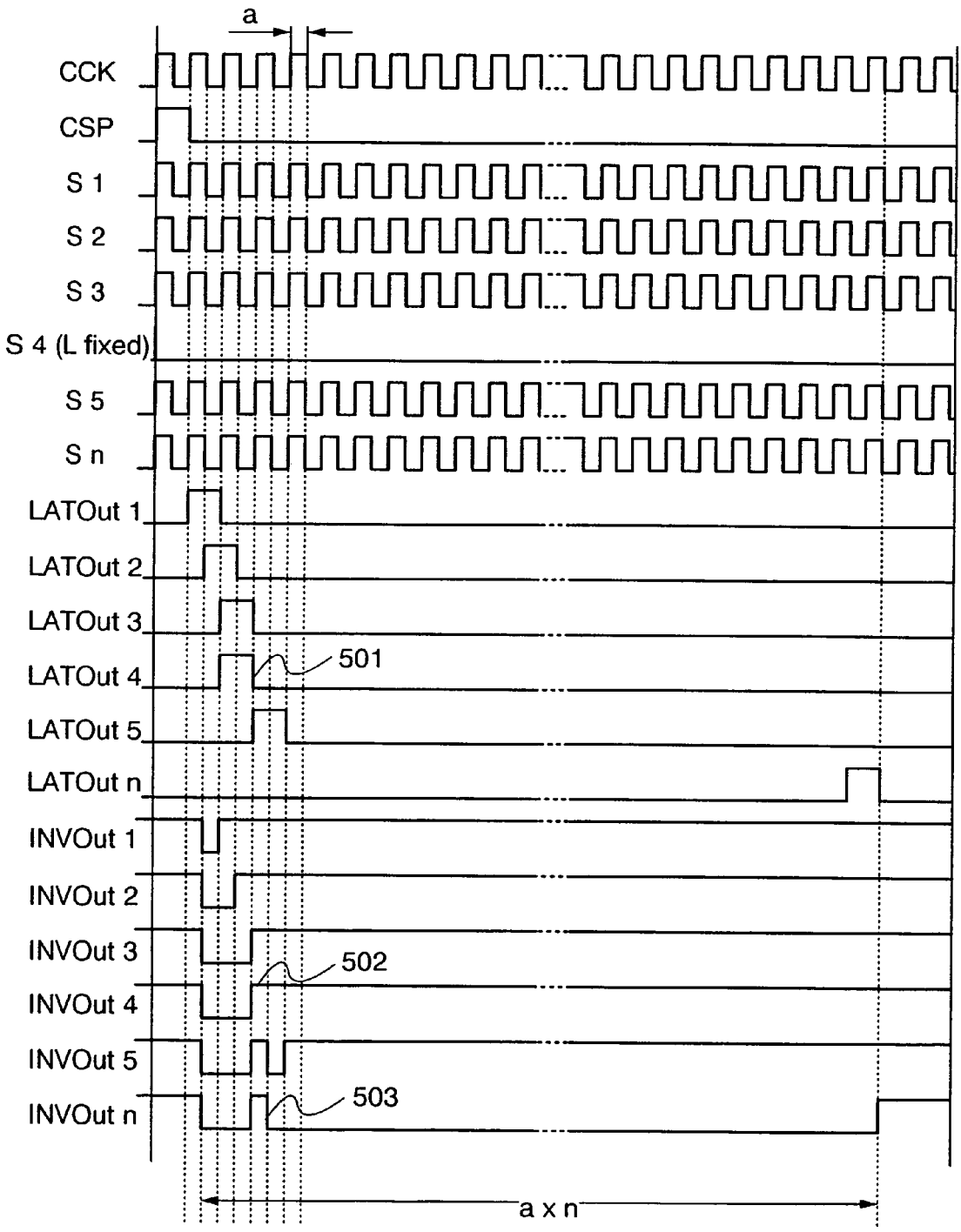
FIG. 5 is a timing chart in malfunction mode B.

FIG. 5 is a timing chart in the malfunction mode B where the source signal line (S4) is fixed to L level regardless of the digital video signal. In this case, the latch circuit 113 of the fourth stage outputs an output (LATOut4) 501 having the same waveform as a pulse inputted from the shift register 112. Referring to the output (INVOut4) of the inverter 118 of the fourth stage, the fourth output 502 in the L level period becomes H level if dividing by a half period of a clock signal. Among outputs of the test output terminals (INVOutn) 107, only the fourth output 503 becomes H level during the L level period (a×n); therefore, the fourth source signal line (S4) is determined to be defective.

Figure 6:
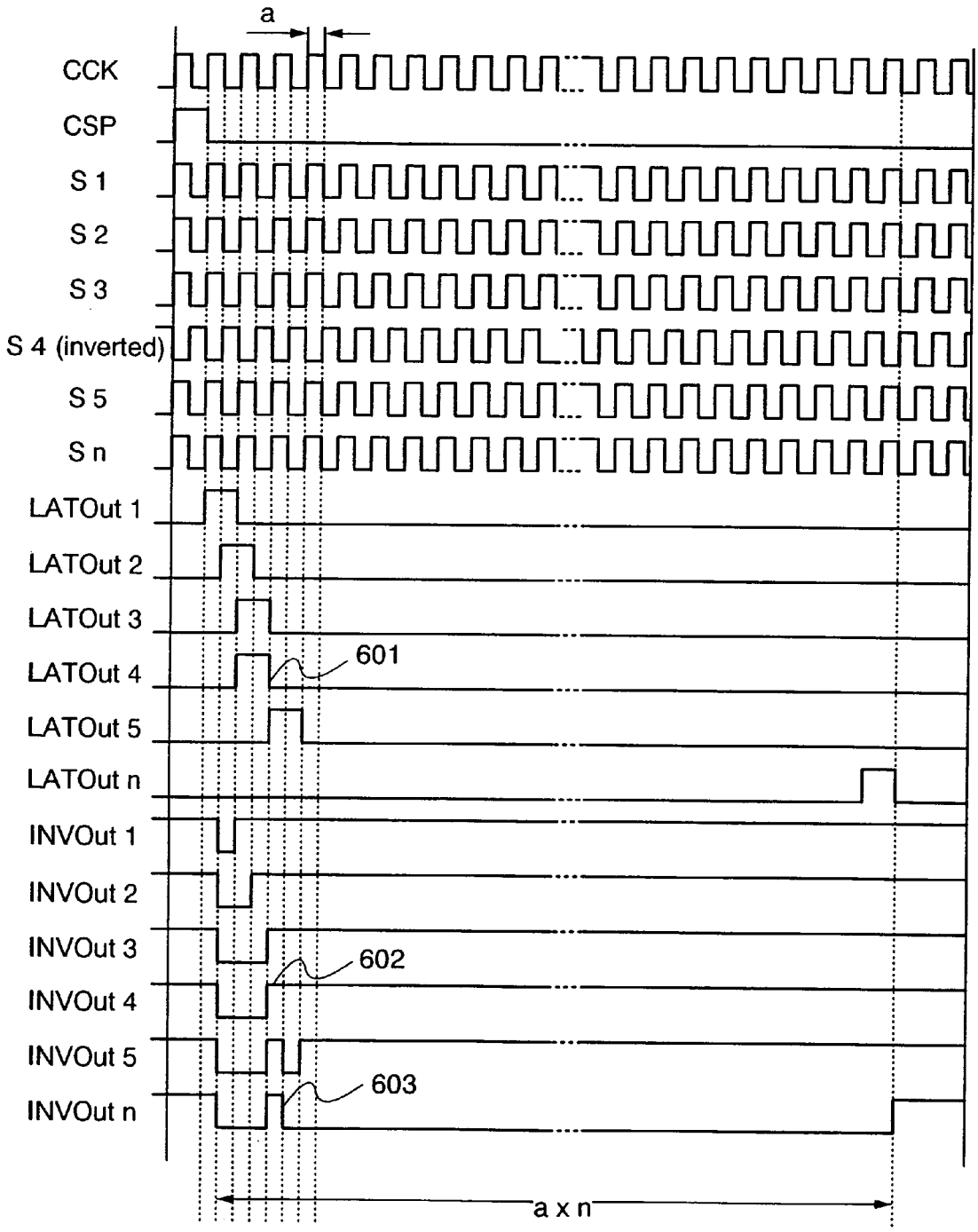
FIG. 6 is a timing chart in malfunction mode C.

FIG. 6 is a timing chart in the malfunction mode C where the output of the source signal line (S4) is inverted to the digital video signal. In this case, the latch circuit 113 of the fourth stage outputs an output (LATOut4) 601 having the same waveform as a pulse inputted from the shift register 112. Referring to the output (INVOut4) of the inverter 118 of the fourth stage, the fourth output 602 in the L level period becomes H level if dividing by a half period of a clock signal. Among outputs of the test output terminals (INVOutn) 107, only the fourth output 603 becomes H level during the L level period (a×n); therefore, the fourth source signal line (S4) is determined to be defective.

Described above are the cases where only one source signal line is defective in all the source signal lines. The malfunction modes D to F show the cases where a plurality of source signal lines are defective.

Figure 7:
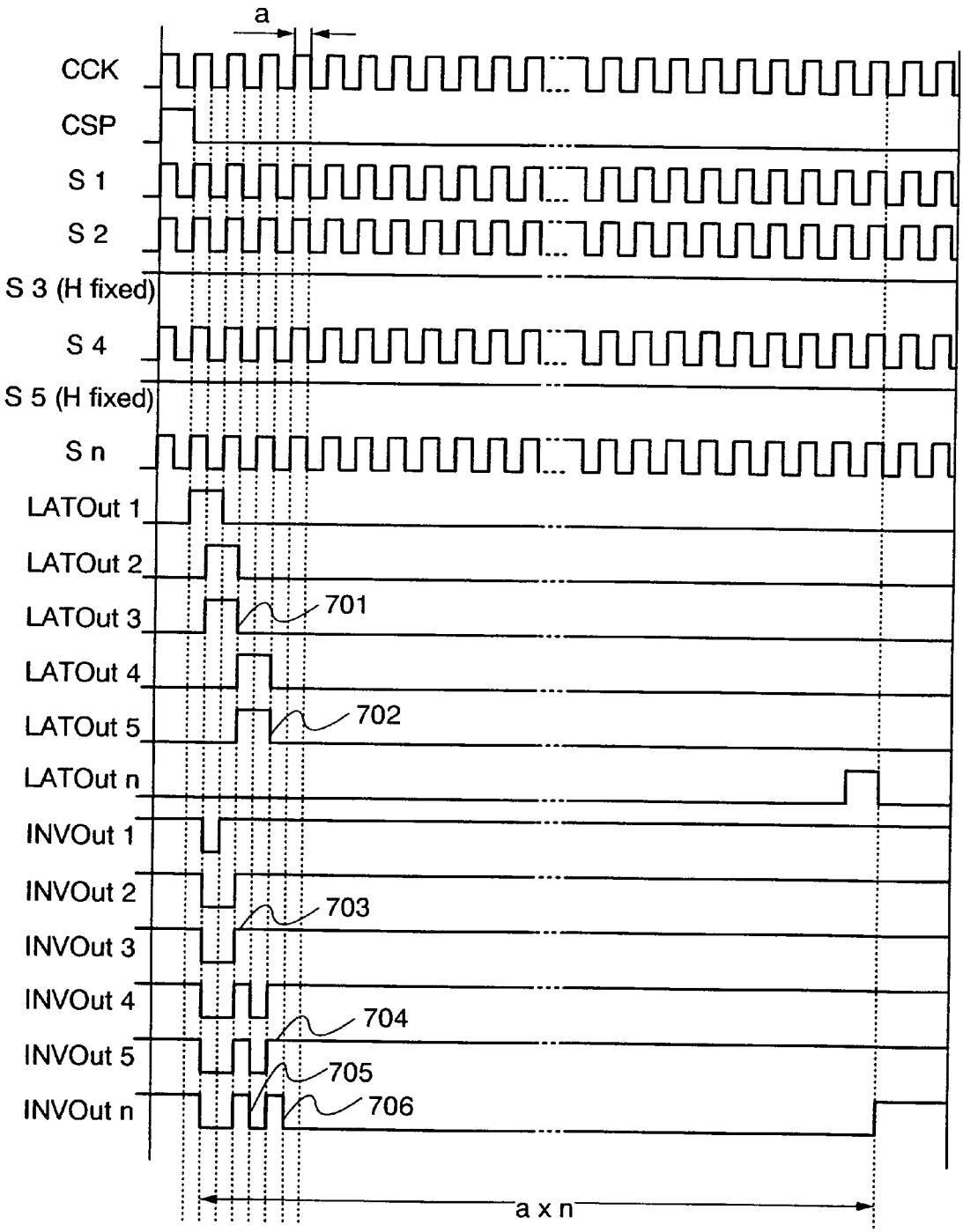
FIG. 7 is a timing chart in malfunction mode D.

FIG. 7 is a timing chart in the malfunction mode D where two source signal lines (S3 and S5) are fixed to H level regardless of the digital video signal. In this case, the latch circuit 113 of the third stage outputs an output (LATOut3) 701 having the same waveform as a pulse inputted from the shift register 112. Referring to an output (INVOut3) of the inverter 118 of the third stage, the third output 703 in the L level period becomes H level if dividing by a half period of a clock signal. Similarly, the latch circuit 113 of the fifth stage outputs an output (LATOut5) 702 having the same waveform as a pulse inputted from the shift register 112. Referring to an output (INVOut5) of the inverter 118 of the fifth stage, the fifth output 704 in the L level period becomes H level if dividing by a half period of a clock signal. Among outputs of the test output terminals (INVOutn) 107, the third output 705 and the fifth output 706 become H level during the L level period (a×n); therefore, the third and fifth source signal lines (S3 and S5) are determined to be defective. In this manner, even when a plurality of source signal lines are defective, the defective points can be determined accurately.

Figure 8:
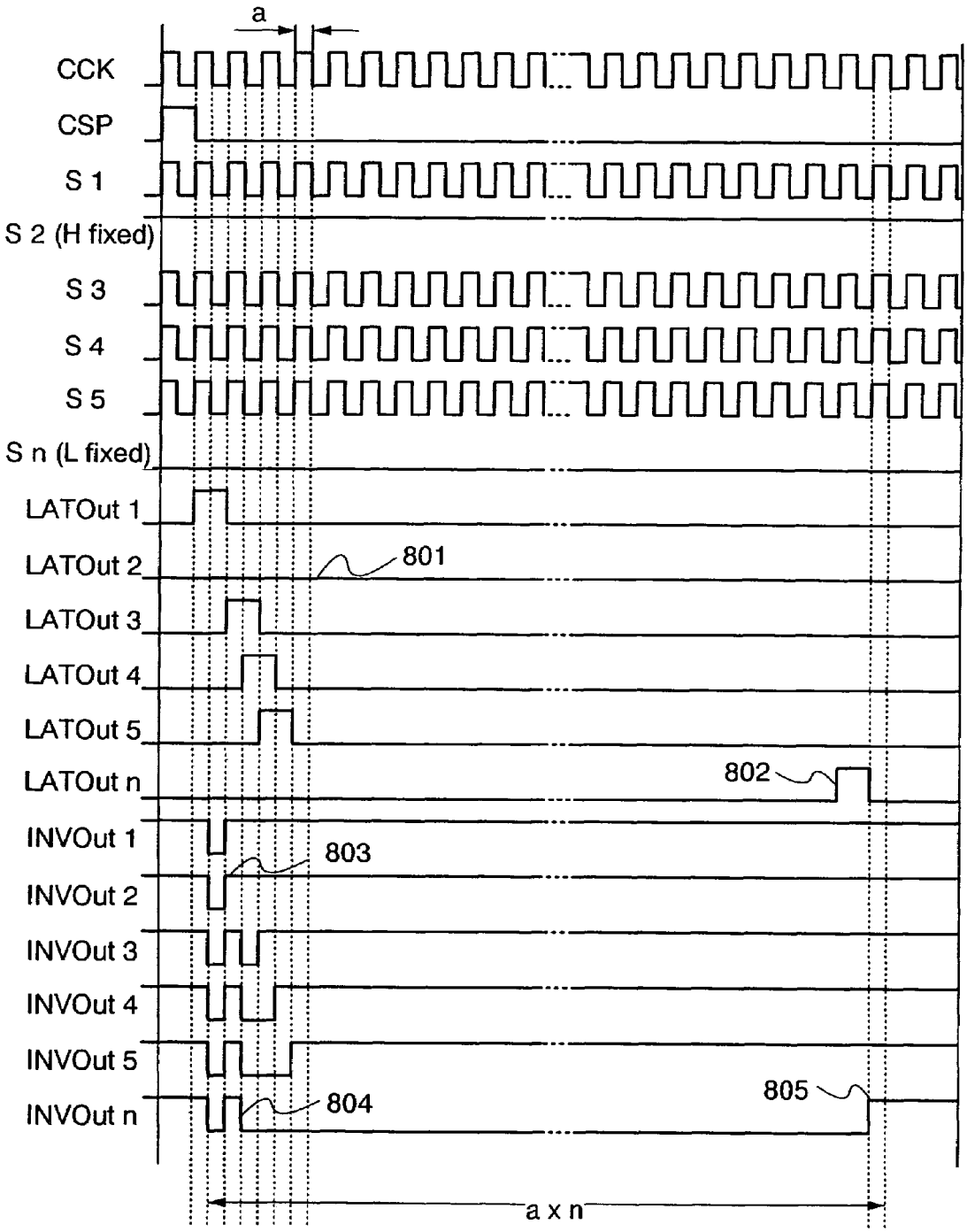
FIG. 8 is a timing chart in malfunction mode E.

FIG. 8 is a timing chart in the malfunction mode E where the source signal line (S2) is fixed to H level regardless of the digital video signal while the source signal line (Sn) is fixed to L level regardless of the digital video signal. In this case, the latch circuit 113 of the second stage outputs an output 801 fixed to L level. Referring to an output (INVOut2) of the inverter 118 of the second stage, the second output 803 in the L level period becomes H level if dividing by a half period of a clock signal. Similarly, the latch circuit 113 of the n-th stage outputs an output (LATOutn) 802 having the same waveform as a pulse inputted from the shift register 112. Among outputs of the test output terminals (INVOutn) 107, the second output 804 and the n-th output 805 become H level during the L level period (a×n); therefore, the second and n-th source signal lines (S2 and Sn) are determined to be defective. In this manner, even when a plurality of source signal lines are defective in different aspects, the defective points can be determined accurately without interfering with each other's test output.

Figure 9:
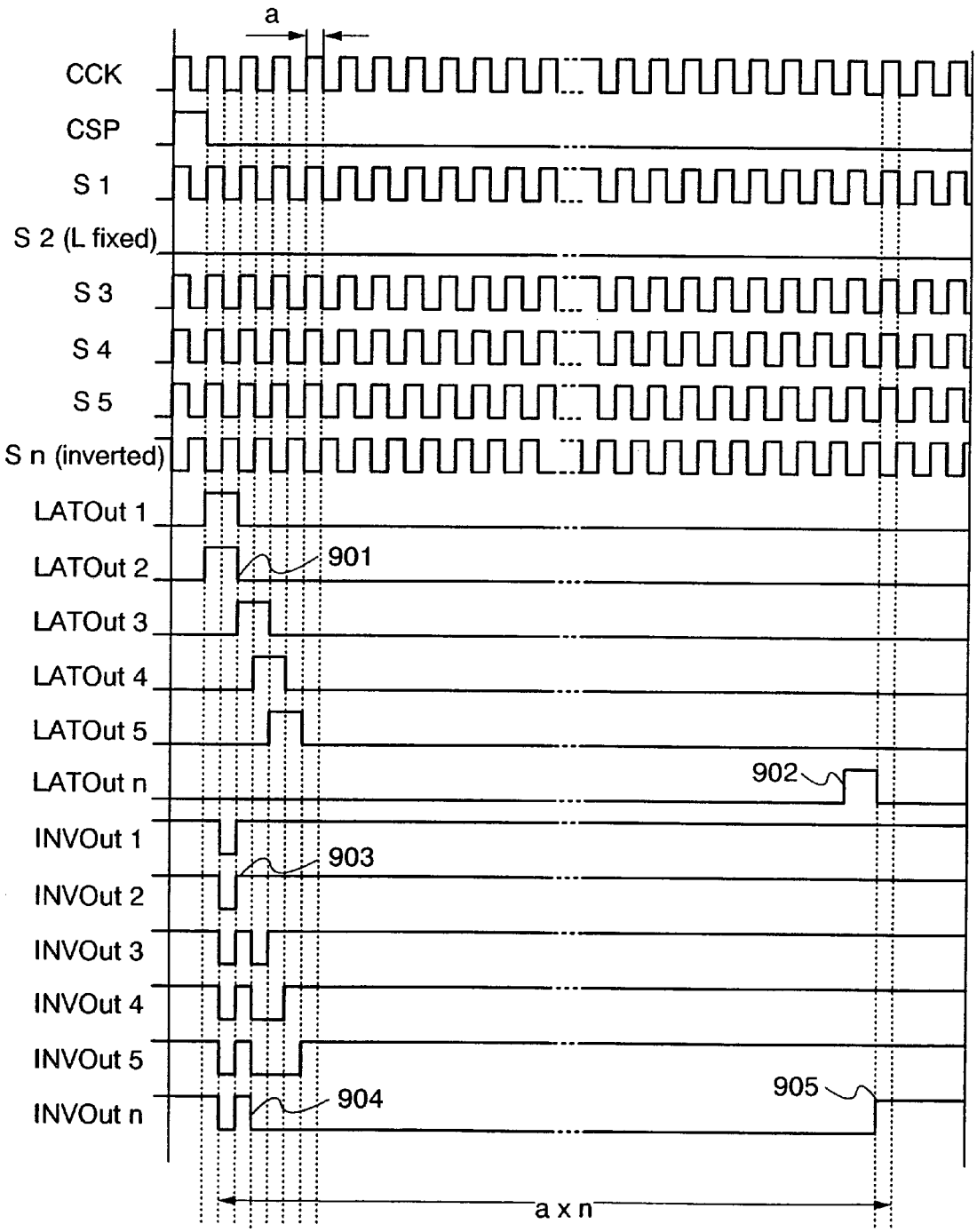
FIG. 9 is a timing chart in malfunction mode F.

FIG. 9 is a timing chart in the malfunction mode F where the source signal line (S2) is fixed to L level regardless of the digital video signal while an output of the source signal line (Sn) is inverted to the digital video signal. In this case, the latch circuit 113 of the second stage outputs an output (LATOut2) 901 having the same waveform as a pulse inputted from the shift register 112. Referring to the output (INVOut2) of the inverter 118 of the second stage, the second output 903 in the L level period becomes H level if dividing by a half period of a clock signal. Similarly, the latch circuit 113 of the n-th stage outputs an output (LATOutn) 902 having the same waveform as a pulse inputted from the shift register 112. Among outputs of the test output terminals (INVOutn) 107, the second output 904 and the n-th output 905 become H level during the L level period (a×n); therefore, the second and n-th source signal lines (S2 and Sn) are determined to be defective. In this manner, even when a plurality of source signal lines are defective in different aspects, the defective points can be determined accurately without interfering with each other's test output.

Figure 10:
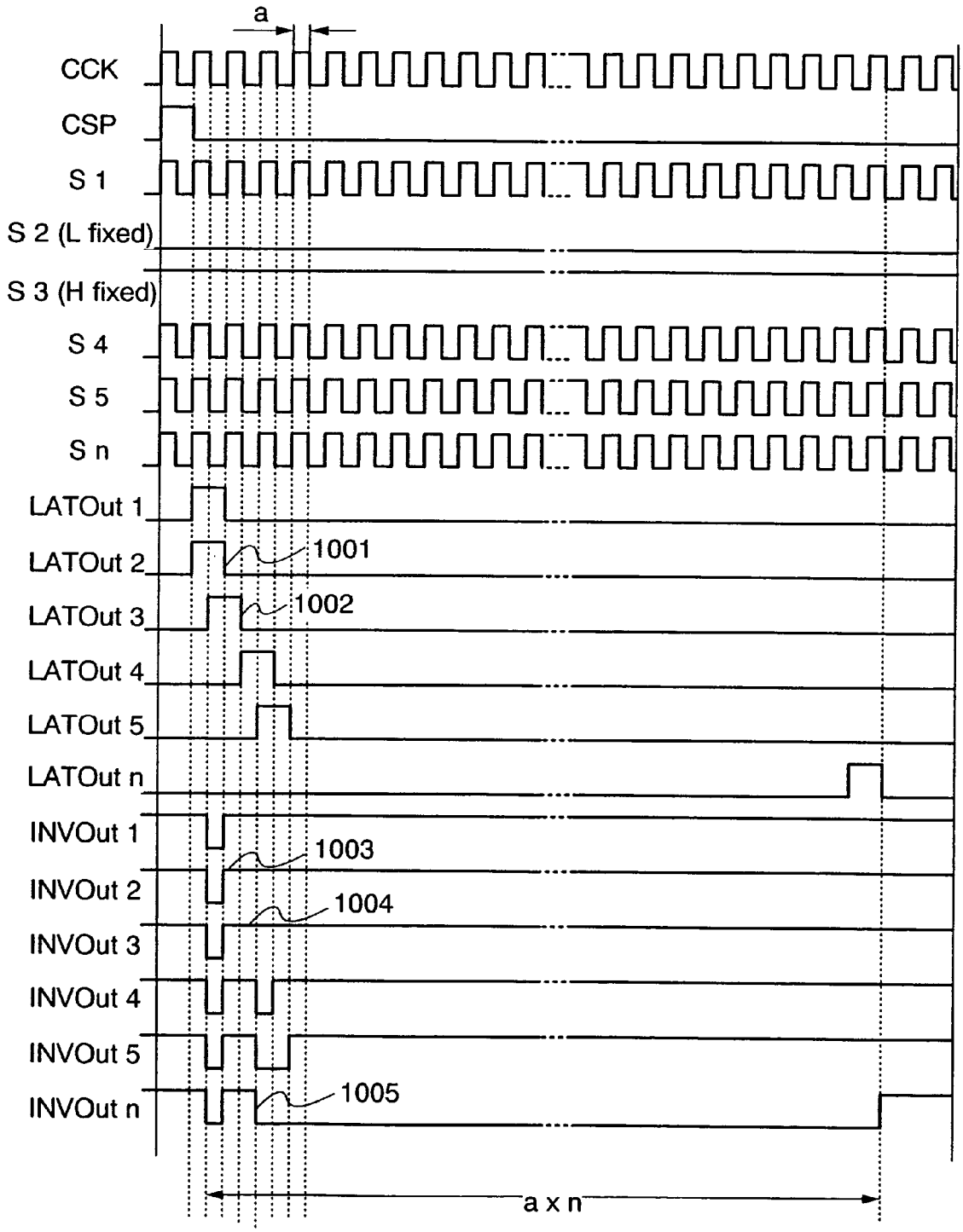
FIG. 10 is a timing chart in malfunction mode G.
Figure 11A:
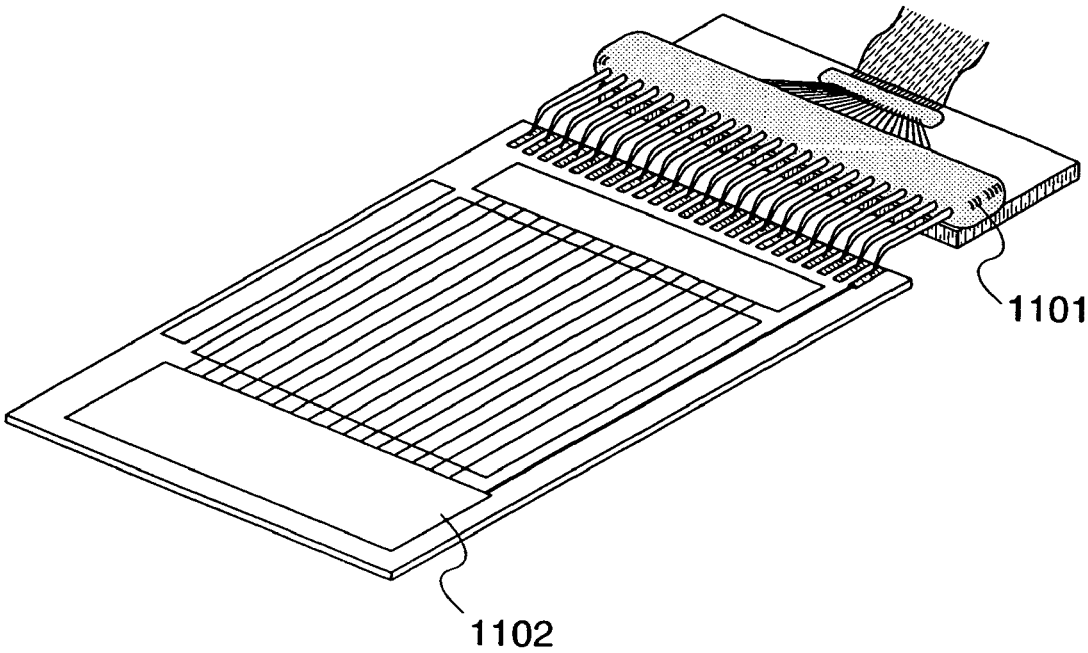
FIGS. 11A and 11B are schematic diagrams each showing a module of the invention and quality control using a probe.
Figure 11B:
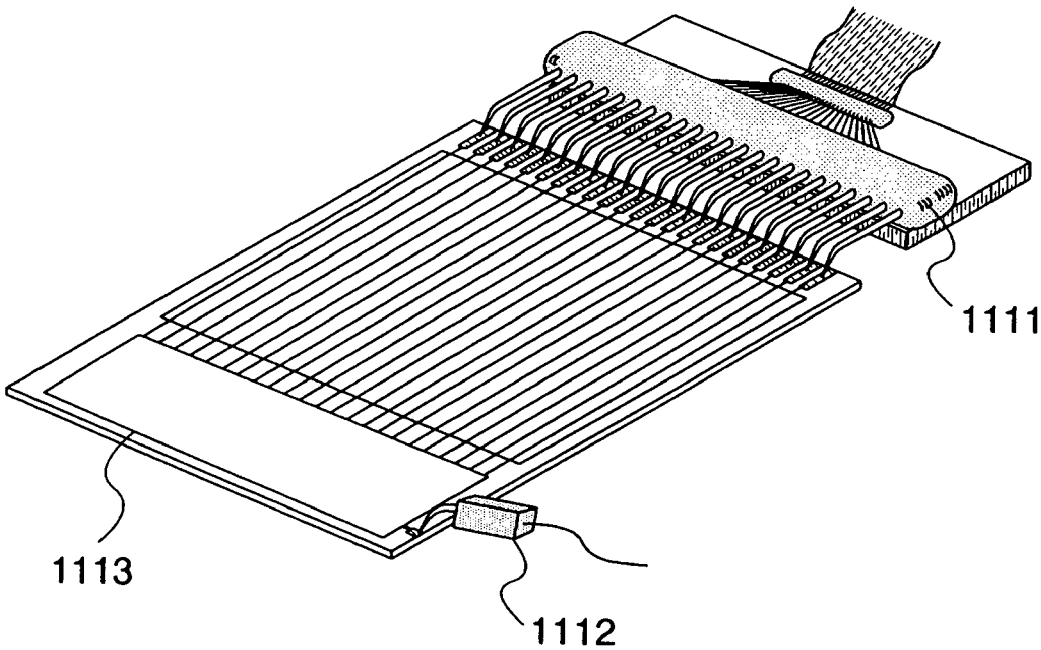

FIG. 10 is a timing chart in the malfunction mode G where the source signal line (S2) is fixed to L level regardless of the digital video signal while the source signal line (S3) is fixed to H level regardless of the digital video signal. In this case, the latch circuit 113 of the second stage outputs an output (LATOut2) 1001 having the same waveform as a pulse inputted from the shift register 112. Referring to the output (INVOut2) of the inverter 118 of the second stage, the second output 1003 in the L level period becomes H level if dividing by a half period of a clock signal. Similarly, the latch circuit 113 of the third stage outputs an output (LATOut2) 1002 having the same waveform as a pulse inputted from the shift register 112. Referring to the output (INVOut3) of the inverter 118 of the third stage, the third output 1004 in the L level period becomes H level if dividing by a half period of a clock signal. Among outputs of the test output terminals (INVOutn) 107, the second and third outputs 1005 become H level during the L level period (a×n); therefore, the second and third source signal lines (S2 and S3) are determined to be defective. In this manner, even when the source signal lines adjacent to each other are defective, the defective points can be determined accurately without interfering with each other's test output.

As set forth above, according to the test circuit of the invention, the presence or absence of a defect as well as a defective point can be highly accurately determined with respect to various kinds of malfunction modes. Further, whether a circuit operates normally can be determined in various kinds of display devices such as LCDs, EL displays, and plasma displays, each of which uses a driver that receives a digital video signal and outputs a digital video signal to a source signal line.

The test circuit shown in FIGS. 1A and 1B is not necessary for actual operation of the display device. Thus, the test circuit may be detached when the pixel area is formed and the substrate is cut to a desired size as a completed module.

Embodiment Mode 2

A display device determined to be non-defective by an effective test using the test circuit of the invention, or determined to be non-defective through the improvement step after the test, may be applied to various electronic apparatuses such as a camera (video camera, or digital camera), a goggle type display (head mounted display), a navigation system, a personal computer, a game machine, a portable information terminal (mobile computer, mobile phone, mobile game machine, or electronic book), and an image reproducing device provided with a recording medium (specifically, a device provided with a display capable of displaying a digital video disc (DVD)). Specific examples of these electronic apparatuses are shown in FIGS. 12A to 12H. Note that the test circuit may be provided in a display portion, though it may be detached as described in Embodiment Mode 1.

Figure 12A:
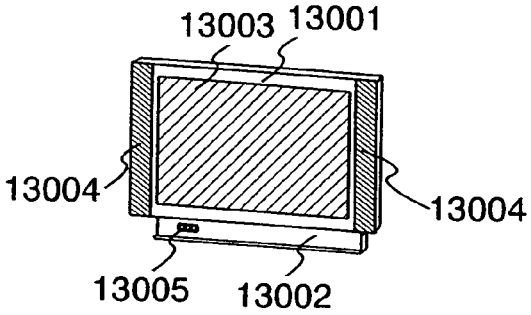
FIGS. 12A to 12H are views each showing an example of an electronic apparatus having a display device of the invention.

FIG. 12A shows a display device having a housing 13001, a support base 13002, a display portion 13003, speaker portions 13004, a video input terminal 13005 and the like. The display device of the invention can be applied to the display portion 13003. Note that the display device includes all display devices for displaying information, such as for personal computers, TV broadcast reception, and advertisement display.

Figure 12B:
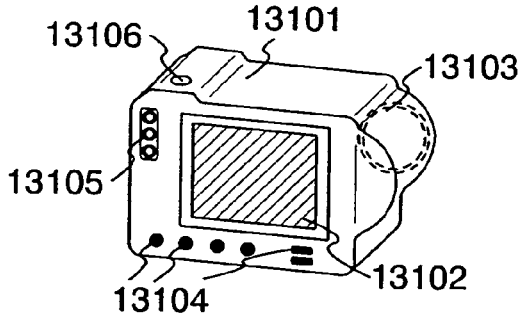

FIG. 12B shows a digital camera having a main body 13101, a display portion 13102, an image receiving portion 13103, operating keys 13104, an external connecting port 13105, a shutter 13106 and the like. The display device of the invention can be applied to the display portion 13102 to complete the digital camera.

Figure 12C:
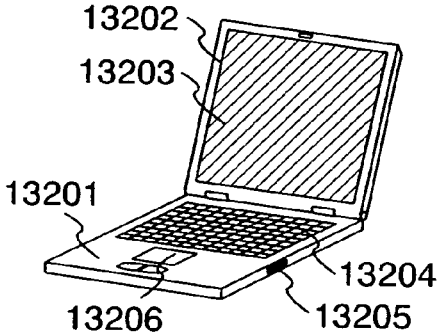

FIG. 12C shows a notebook personal computer having a main body 13201, a housing 13202, a display portion 13203, a keyboard 13204, an external connecting port 13205, a pointing mouse 13206 and the like. The display device of the invention can be applied to the display portion 13203.

Figure 12D:
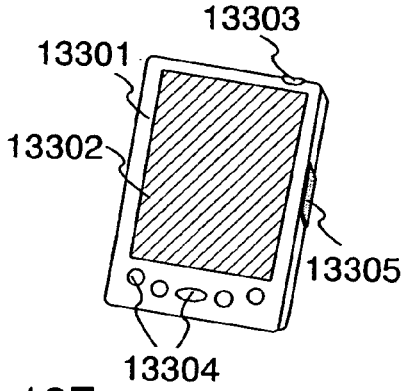

FIG. 12D shows a mobile computer having a main body 13301, a display portion 13302, a switch 13303, operating keys 13304, an infrared port 13305 and the like. The display device of the invention can be applied to the display portion 13302.

Figure 12E:
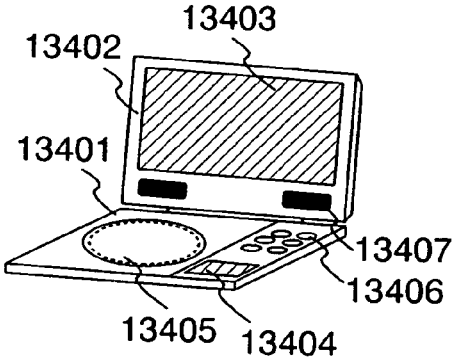

FIG. 12E shows a portable image reproducing device provided with a recording medium (specifically, a DVD reproducing device), which has a main body 13401, a housing 13402, a display portion A 13403, a display portion B 13404, a recording medium (such as a DVD) reading portion 13405, an operating key 13406, a speaker portion 13407 and the like. The display portion A 13403 mainly displays image information while the display portion B 13404 mainly displays character information and operating information. The display device of the invention can be applied to the display portion A 13403 and the display portion B 13404. Note that the image reproducing device provided with a recording medium includes a home game machine and the like.

Figure 12F:
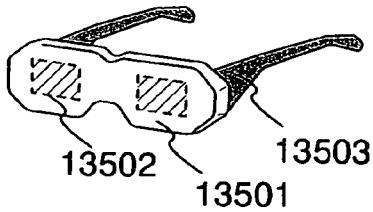

FIG. 12F shows a goggle type display (head mounted display) having a main body 13501, a display portion 13502, an arm portion 13503 and the like. The display device of the invention can be applied to the display portion 13502.

Figure 12G:
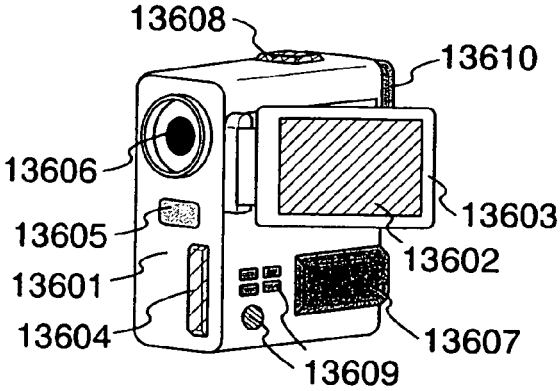

FIG. 12G shows a video camera having a main body 13601, a display portion 13602, a housing 13603, an external connecting port 13604, a remote control receiving portion 13605, an image receiving portion 13606, a battery 13607, an audio input portion 13608, operating keys 13609, an eyepiece portion 13610 and the like. The invention can be applied to the display portion 13602 to complete the video camera.

Figure 12H:
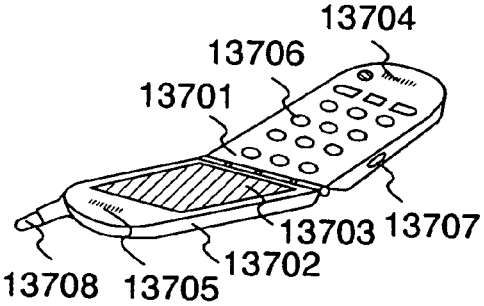
Figure 13:
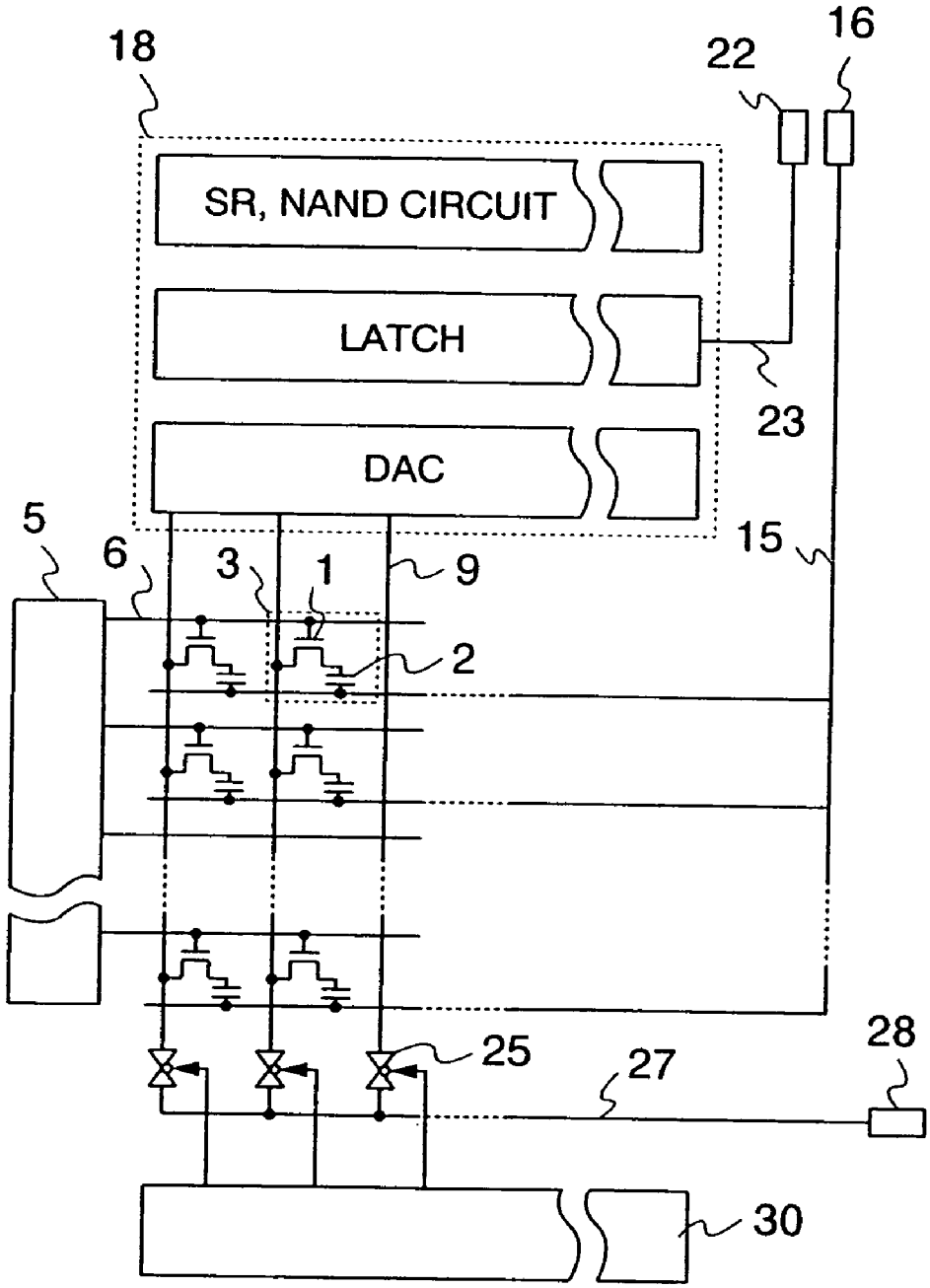
FIG. 13 is a diagram showing a configuration of a display device having a conventional test circuit.
Figure 14A:
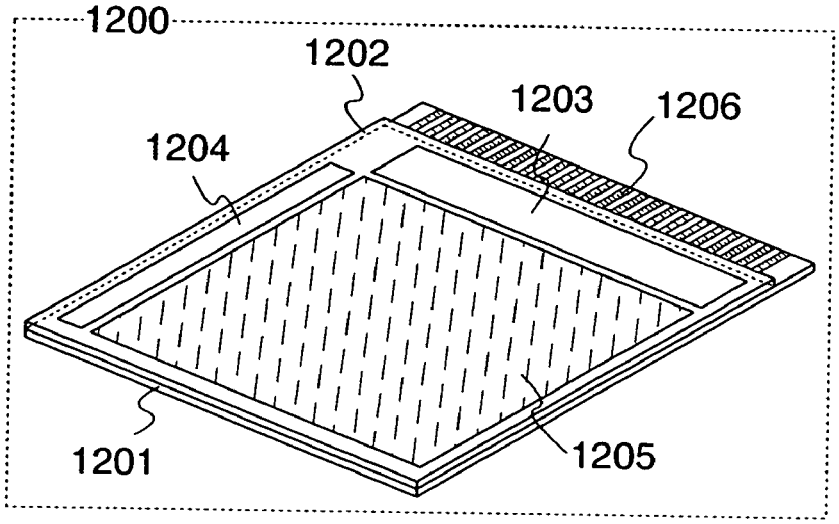
FIG. 14A is a schematic diagram showing a conventional module and FIG. 14B is a schematic diagram showing conventional quality control using a probe.
Figure 14B:
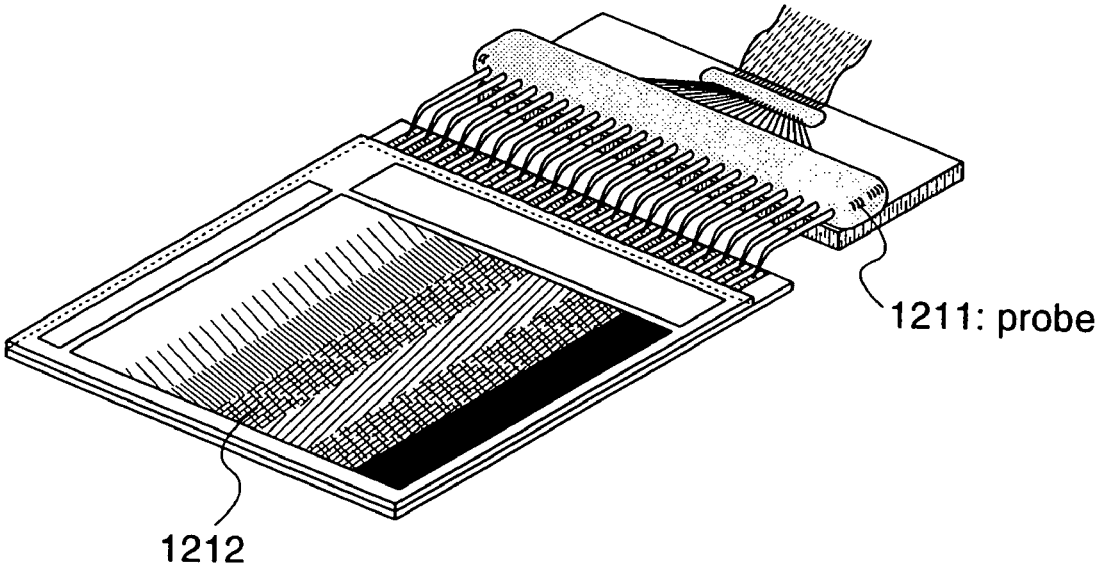

FIG. 12H shows a mobile phone having a main body 13701, a housing 13702, a display portion 13703, an audio input portion 13704, an audio output portion 13705, an operating key 13706, an external connecting port 13707, an antenna 13708 and the like. The display device of the invention can be applied to the display portion 13703.

This application is based on Japanese Patent Application Ser. No. 2004-353292 filed in Japan Patent Office on Dec. 6, 2004, the entire contents of which are hereby incorporated by reference.

What is claimed is:

1. A test circuit of a display device comprising a plurality of pixels arranged in matrix, and a plurality of source signal lines for inputting a video signal to each of the plurality of pixels, comprising:

a plurality of shift registers;

a plurality of latch circuits;

a plurality of first NOR circuits;

a plurality of second NOR circuits;

a plurality of first NAND circuits;

a plurality of second NAND circuits; and a plurality of inverters, wherein the plurality of shift registers are connected in series to each other;

wherein the plurality of shift registers are electrically connected to the respective plurality of latch circuits;

wherein first input terminals of the plurality of first NOR circuits are electrically connected to the respective plurality of shift registers;

wherein second input terminals of the plurality of first NOR circuits are electrically connected to the respective plurality of latch circuits;

wherein the plurality of source signal lines are electrically connected to the respective plurality of latch circuits;

wherein the plurality of second NOR circuits are connected in parallel to each other;

wherein the plurality of second NOR circuits are electrically connected to the respective plurality of first NOR circuits;

wherein the plurality of first NAND circuits are connected in parallel to each other;

wherein the plurality of first NAND circuits are electrically connected to the respective plurality of second NOR circuits;

wherein the plurality of first NAND circuits are electrically connected to the respective plurality of second NAND circuits;

wherein among the plurality of second NAND circuits connected in series, a second input terminal of the NAND circuit of a first stage is electrically connected to a power supply;

wherein input terminals of the plurality of inverters are electrically connected to output terminals of the plurality of second NAND circuits;

wherein output terminals of the plurality of inverters are electrically connected to input terminals of the plurality of second NAND circuits that are different from the plurality of second NAND circuits connected to the input terminals of the plurality of inverters; and wherein the output terminal of the inverter of a last stage is electrically connected to a test output terminal.

2. A display device comprising the test circuit according to claim 1, wherein the test circuit is formed over the same substrate as the plurality of pixels.

3. A test circuit of a display device according to claim 1, wherein the plurality of shift resisters sequentially output pulses by inputs of a clock signal, an inversed clock signal and a start pulse.

4. A test circuit of a display device according to claim 1, wherein each of the plurality of source signal lines is directly connected to one clocked inverter and is connected to the other clocked inverter through an inverter.

5. A test circuit of a display device according to claim 1, wherein a position of an inverter in an odd-numbered stage and a position of an inverter in an even-numbered stage are reverse.

6. A test circuit of a display device according to claim 1, wherein the test circuit is mounted on an outside of a panel.

7. A test circuit of a display device according to claim 1, wherein the test circuit can be detached after a test.

8. A test circuit of a display device according to claim 1, wherein a defective point can be determined in all stages by checking an output of the test output terminal connected to the test circuit of the last stage.

9. A test circuit of a display device that displays an image using a digital video signal, comprising:

a plurality of shift registers;

a plurality of latch circuits;

a plurality of first NOR circuits;

a plurality of second NOR circuits;

a plurality of first NAND circuits;

a plurality of second NAND circuits; and a plurality of inverters, wherein the plurality of shift registers are connected in series to each other;

wherein the plurality of shift registers are electrically connected to the respective plurality of latch circuits;

wherein first input terminals of the plurality of first NOR circuits are electrically connected to the respective plurality of shift registers;

wherein second input terminals of the plurality of first NOR circuits are electrically connected to the respective plurality of latch circuits;

wherein the plurality of source signal lines are electrically connected to the respective plurality of latch circuits;

wherein the plurality of second NOR circuits are connected in parallel to each other;

wherein the plurality of second NOR circuits are electrically connected to the respective plurality of first NOR circuits;

wherein the plurality of first NAND circuits are connected in parallel to each other;

wherein the plurality of first NAND circuits are electrically connected to the respective plurality of second NOR circuits;

wherein the plurality of first NAND circuits are electrically connected to the respective plurality of second NAND circuits;

wherein among the plurality of second NAND circuits connected in series, a second input terminal of the NAND circuit of a first stage is electrically connected to a power supply;

wherein input terminals of the plurality of inverters are electrically connected to output terminals of the plurality of second NAND circuits;

wherein output terminals of the plurality of inverters are electrically connected to input terminals of the plurality of second NAND circuits that are different from the plurality of second NAND circuits connected to the input terminals of the plurality of inverters; and wherein the output terminal of the inverter of a last stage is electrically connected to a test output terminal.

10. A test circuit of a display device according to claim 9, wherein the plurality of shift resisters sequentially output pulses by inputs of a clock signal, an inversed clock signal and a start pulse.

11. A test circuit of a display device according to claim 9, wherein each of the plurality of source signal lines is directly connected to one clocked inverter and is connected to the other clocked inverter through an inverter.

12. A test circuit of a display device according to claim 9, wherein a position of an inverter in an odd-numbered stage and a position of an inverter in an even-numbered stage are reverse.

13. A test circuit of a display device according to claim 9, wherein the test circuit is mounted on an outside of a panel.

14. A test circuit of a display device according to claim 9, wherein the test circuit can be detached after a test.

15. A test circuit of a display device according to claim 9, wherein a defective point can be determined in all stages by checking an output of the test output terminal connected to the test circuit of the last stage.

* * * * *